United States Patent [19]

Swinehart

[11] 3,947,647

[45] Mar. 30, 1976

[54] MICROPHONE HAVING IMPROVED TRANSDUCER SUPPORT

[75] Inventor: Frank Swinehart, Waseca, Minn.

[73] Assignee: E. F. Johnson Company, Waseca, Minn.

[22] Filed: Mar. 21, 1974

[21] Appl. No.: 453,345

[52] U.S. Cl. ..... 179/179; 179/110 A; 179/140; 179/145

[51] Int. Cl.[2] ..... H04R 17/02

[58] Field of Search ..... 179/179, 110 A, 138 R, 179/138 VL, 140, 141, 145

[56] References Cited

UNITED STATES PATENTS

| | | | |
|---|---|---|---|
| 3,329,776 | 7/1967 | Goy et al. | 179/110 A |
| 3,577,020 | 5/1971 | Carlson et al. | 310/8.2 |
| 3,660,602 | 5/1972 | Thompson | 179/1 A |

*Primary Examiner*—Thomas W. Brown
*Attorney, Agent, or Firm*—Warren A. Sturm

[57] ABSTRACT

A shock resistant microphone embodying a piezoelectric transducing element that is held in operative disposition with respect to an electrode and a diaphragm by a resilient spring also forming a second electrode.

10 Claims, 3 Drawing Figures

MICROPHONE HAVING IMPROVED TRANSDUCER SUPPORT

BRIEF SUMMARY OF THE INVENTION

My invention relates generally to piezoelectric transducers and is more particularly directed to such transducers which are used to transform sonic or ultrasonic compressional wave signals into corresponding electrical signals.

The uncomplicated construction of my invention provides an easy-to-assemble, rugged microphone which may be produced for far less than presently known microphones of comparable quality and physical size and resistance to shock or other unduly large forces which may be exerted on the completed assembly.

It is therefore an object of my invention to provide an improved microphone that may be easily assembled.

Another object of my invention is to provide a microphone which exhibits a high degree of resistance to malfunction due to the subjection thereof to large forces.

Other objects and advantages of my invention will become apparent from a consideration of the appended specification, claims, and drawings in which:

Figure 1:
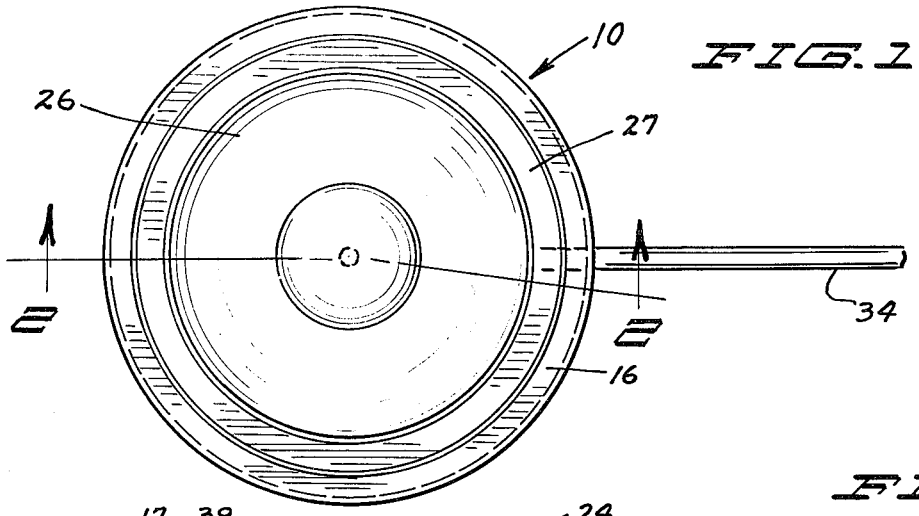
FIG. 1 is a plan view of an assembled microphone incorporating the principles of my invention.
Figure 2:
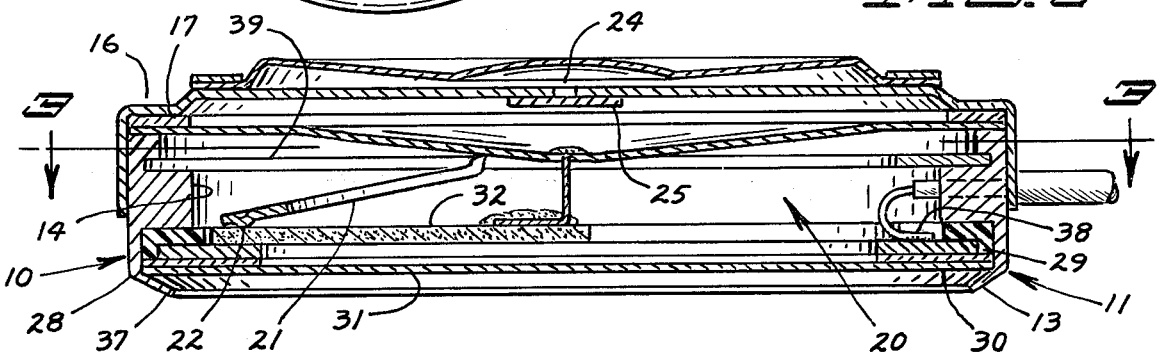
FIG. 2 is an enlarged elevational view of FIG. 1 of the drawing taken along section line 2—2.
Figure 3:
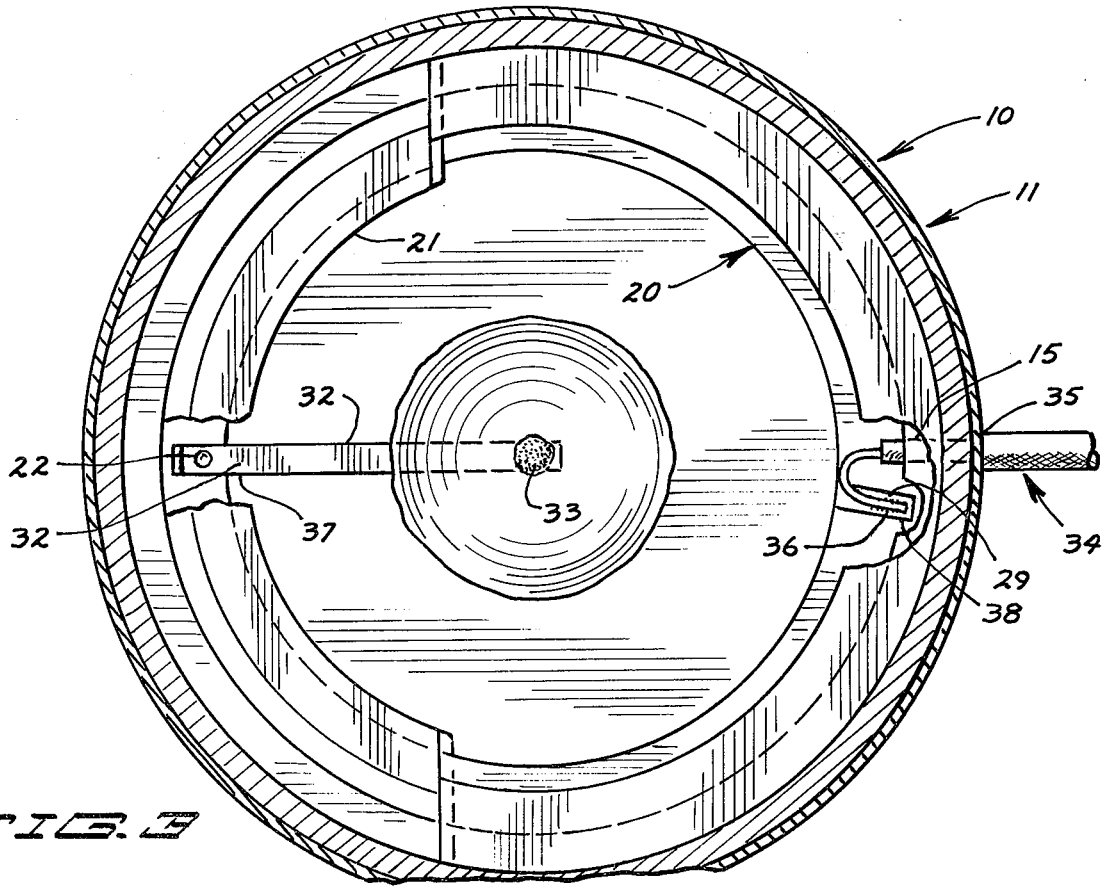
FIG. 3 is an enlarged sectional plan view taken along section line 3—3 in FIG. 2 and includes a plurality of windows to indicate details of the preferred embodiment.

Referring to FIGS. 1, 2 and 3 of the drawings in which like elements are identified with like reference characters, a microphone is shown indicated generally by reference character 10 and this microphone is normally of a size which characterizes it as a miniature microphone and is in the nature of five-eighths to seven-eighths inch in diameter and might be incorporated in, for example, portable communications equipment.

Microphone 10 is comprised of a conductive housing 11 having a top cover 16 and a bottom cover or disk 31. A shielded microphone cable 34 extends toward the interior of conductive housing 11 through an aperture 15. The outer braided shield 35 is conductively connected through suitable means, not shown, to the outside of housing 11.

Housing 11 is provided with a top portion 12, a bottom portion 13, a center web of smaller diameter 14. An aperture 15 extends thereinto and in proximity to web 14. A further washer retaining groove, 39, of suitable depth is disposed adjacent the top of web 14 for purposes to be explained below.

Cover member, 16, having a center aperture 24 and a screen 25 is shown disposed to close top end 12 of housing 11. A weather resistant cover 26 is shown disposed on the top of cover 16 and is shown held in place by a washer-like retainer 27, both of which may be held in place through the use of suitable adhesives or the like.

The bottom portion 13 of housing 11 is closed by bottom disk 31 which is held in place by suitable rolling or rimming of the bottom portion 13 of conductive housing 11 thereover. Bottom disk or cover 31 serves to retain an assembly comprised of an insulating shoulder washer 28, a contact ring washer 29 and an insulating washer 30 in disposition adjacent the lower portion of center web 14 of housing 11 in the manner shown in FIG. 2 of the drawings.

Insulating shoulder washer 28 is shown with a small notch 37 at its left end for slidably receiving the end of a piezoelectric bender-type element to be described below, said notch opening inwardly to the interior of microphone 10. In similar manner, a wider notch 38 is shown disposed adjacent aperture 15 in housing 11 and serves to expose a portion of the top of conductive contact ring 29 whereat conductor 36 of shielded lead 34 is conductively connected, as by soldering, to conductive contact ring 29. It may be seen that insulating shoulder washer 28 and insulation washer 30 serve to insulatedly support and retain conductive contact ring 29 therebetween and to provide upwardly and inwardly openings to expose surfaces of conductive contact ring 29 through notches 37 and 38, respectively.

Groove 39 is shown disposed adjacent the top edge of center web 14 and serves to receive and retain a conductive washer 20 comprised of spring-like material. Washer 20 is provided with an enlarged peripheral circumferential portion which extends for greater than 180°, as indicated by reference character 23 and is provided with a second portion 21 which is of lesser diameter and extends diagonally downwardly toward the lower portion of the microphone assembly. Portion 21 includes a downwardly extending contact or dimple 22 at its lower lefthand end for purposes to be explained below. Washer 20 is preferably provided with a circumferential arcuate enlarged portion 23 that is substantially equal to the diameter of the outer portion of groove 39, so that conductive member 20 may be assembled thereto with, for example, high speed production machinery and yet be reliably retained in place. The arcuate extent of portion 23 should preferably be greater than 180° and less than that value which would preclude easy assembly into groove 39 of the microphone housing. In one embodiment of my invention, an angular arcuate size of 220° was utilized for portion 23 of conductive spring washer 20. Groove 39 may be formed by suitable means and it is anticipated that under certain conditions, conductive washer 20 may be disposed on top of web 14 and held in place by other suitable means, such as a spacer washer, suitable adhesives or soldering.

A diaphragm member 18, shown in the form of transparent plastic, is disposed over the top of conductive housing 11 and is held in place by a suitable washer 17. The center of diaphragm 18 is connected to a drive pin 33 which has its lower end connected to a piezoelectric drive member 32 which may preferably be of the type shown and described in my patent for Microphone Having Improved Piezoelectric Transducer Supports, issued Jan. 9, 1973, as U.S. Pat. No. 3,710,040. The other end of piezoelectric drive element 32 is slidably disposed in notch 37 on insulating washer 28 so that its lower surface will be in conductive engagement with a portion of the top surface of conductive washer 29 and thence to conductor 36 in shielded cable 34. The top side of piezoelectric member 32 is connected to shield 35 on shielded cable 34 through dimple 22 at the lower downwardly depending portion 21 of conductive spring washer 20 and housing 11, which is in conductive engagement with the larger outwardly extending peripheral portion 23 of conductive spring washer 20, to shield 35 on cable 34.

It may thus be seen that a complete microphone, as shown in FIG. 2, may be easily fabricated from uncomplicated elements.

Testing of the microphone has exhibited its superior resistance to the shock to which portable communications equipment may be subjected while retaining the desirable operational characteristics required for such apparatus.

Having now therefore fully illustrated and described my invention, what I claim to be new and desire to protect by Letters Patent is:

1. In a microphone having a diaphragm and transducer connected to be driven thereby, the combination comprising:

a hollow housing having a top, bottom and of substantially constant lateral cross section;

elongated transducer means;

conductive means of like lateral cross section insulatedly mounted in proximity to the bottom of said housing;

an insulating washer of like lateral cross section mounted in proximity to the bottom of said housing on top of said conductive means, said washer having an inwardly, upwardly, opening notch disposed over said conductive means and adjacent to a side wall of said housing whereby the bottom of one end of said transducer means may be disposed in said opening in conductive supporting engagement on said conductive means; and a conductive spring washer having a first portion fixedly mounted intermediate the top and bottom of said housing and having an outside lateral dimension greater than the lateral interior of said housing for more than one-half of the outer peripheral dimension of said housing, and a second portion having an outside lateral dimension less than the lateral interior dimension of said housing, but greater than that of the interior lateral dimension of said insulating washer, for less than one-half of the peripheral dimension of said housing, said last named portion extending downwardly toward the top of said insulating washer and said transducer means and in registration with the notch in said insulating washer, whereby the top of said end of said transducer is conductively engaged by the second portion of said conductive spring washer.

2. The subject matter of claim 1 in which the housing is cylindrical in shape.

3. The subject matter of claim 2 in which the housing includes an inwardly opening groove intermediate its top and bottom ends and the first portion of the conductive washer is disposed in said groove.

4. The subject matter of claim 1 in which the housing includes an inwardly opening groove intermediate its top and bottom ends and the first portion of the conductive washer is disposed in said groove.

5. The subject matter of claim 1 in which the second portion of the conductive spring washer includes a downwardly extending dimple in registration with the notch in the insulation washer.

6. The subject matter of claim 3 in which the second portion of the conductive spring washer includes a downwardly extending dimple in registration with the notch in the insulating washer.

7. The subject matter of claim 5 in which the housing includes an inwardly opening groove intermediate its top and bottom ends and the first portion of the conductive washer is disposed in said groove.

8. The subject matter of claim 1 in which the housing is comprised of current conductive material.

9. The subject matter of claim 2 in which the housing is comprised of current conductive material.

10. The subject matter of claim 4 in which the housing is comprised of current conductive material.

* * * * *

UNITED STATES PATENT OFFICE

CERTIFICATE OF CORRECTION

Patent No. 3,947,647 Dated March 30, 1976

Inventor(s) Frank Swinehart

It is certified that error appears in the above-identified patent and that said Letters Patent are hereby corrected as shown below:

Column 4, line 23, "insulation" should read -- insulating --.

Signed and Sealed this eighth Day of June 1976

[SEAL]

*Attest:*

RUTH C. MASON
*Attesting Officer*

C. MARSHALL DANN
*Commissioner of Patents and Trademarks*